United States Patent [19]

King

[11] Patent Number: 5,010,939

[45] Date of Patent: Apr. 30, 1991

[54] BLIND FOR ARCHED WINDOWS

[76] Inventor: William J. King, 108 Cheyenne Ct., Newark, Del. 19702

[21] Appl. No.: 480,916

[22] Filed: Feb. 16, 1990

[51] Int. Cl.[5] ..... E06B 3/94

[52] U.S. Cl. ..... 160/84.1; 160/134; 74/417

[58] Field of Search ..... 160/84.1, 134, 117, 160/119; 74/417, 425

[56] References Cited

U.S. PATENT DOCUMENTS

| | | | |
|---|---|---|---|
| 451,068 | 4/1891 | Park . | |
| 553,375 | 1/1896 | Williams | 160/119 X |
| 602,967 | 4/1898 | Wells . | |
| 1,321,697 | 11/1919 | Alfano | 160/117 X |
| 1,609,877 | 12/1926 | Kendall . | |
| 1,747,178 | 2/1930 | Morse | 160/117 |
| 1,969,287 | 8/1934 | Wornick | 160/119 |
| 2,268,552 | 1/1942 | Rhines | 74/447 |
| 2,567,528 | 9/1951 | Rosenthal | 160/35 X |
| 3,386,106 | 6/1968 | Clemens | 160/84.1 X |
| 4,699,195 | 10/1987 | Lester | 160/134 |
| 4,861,090 | 8/1989 | Gavrieli | 160/134 |
| 4,934,436 | 6/1990 | Schnebly | 160/134 X |

FOREIGN PATENT DOCUMENTS

| | | | |
|---|---|---|---|
| 1256866 | 2/1961 | France | 160/134 |

*Primary Examiner*—Blair M. Johnson
*Attorney, Agent, or Firm*—E. Vassiliou

[57] ABSTRACT

A foldable arcuate blind for arched windows using a central transmission mechanism for opening and closing.

6 Claims, 5 Drawing Sheets

BLIND FOR ARCHED WINDOWS

1. FIELD OF THE INVENTION

This invention relates to blinds for windows, and more specifically to foldable arcuate blinds for arched windows.

2. BACKGROUND OF THE INVENTION

There is a large variety of blinds or shades for windows in the marketplace, including both vertical and horizontal types. Their most common characteristic is that they are foldable and that they have a rectangular shape, when they are in an unfolded position.

Since also most conventional windows are rectangular in shape, no problem is encountered for this class of windows. There is, however, a better class of windows of higher finesse and elegance, which have at least one arched portion. This class of windows is generally referred to as arched windows. It becomes evident then, that the conventional blinds, having a rectangular shape, may not be used in conjunction with arched windows.

Although it might sound as a simple problem to solve, it certainly is not. Mere proof of this is the fact that the applicant has not been able to find such a blind available in the marketplace.

A number of attempts have been made, but apparently they have all failed to provide an effective solution, since none of these approaches has been accepted by the public, as the absence of commercially available blinds for arched windows evidences.

Representative references describing blinds for arched windows may be found in the patent literature as early as 1891, but after the first quarter of the 20th century, no substantial progress seems to have been made.

U.S. Pat. Nos. 451,068, Lark, issued 4-28-91, 602,967, Wells, issued 4-26-1893, and 1,609,877, Kendall, issued 12-7-1926, disclose blinds for arched windows, which, however are driven by cumbersome cord mechanisms acting o the outside circumference of the blind, and having serious disadvantages, such as for example the need for hiding these mechanisms within an extended portion of the blind, thus sacrificing useful window area, as well as decorative window aspects. Other serious disadvantages include, but are not limited to, the fact that the complicated cord mechanisms are liable to malfunction, to the fact that no effective way of maintaining the opening of the blind at any desired level is provided, and to the fact that blinds structured to be driven by cord mechanisms at their circumference are not easily controllable, and therefore flimsy in their operation.

3. SUMMARY OF THE INVENTION

This invention is directed to an arcuate blind for arched windows having a first assembly of elements comprising:

a base having an upper side and a lower side;

an arcuately foldable body having a stationary radial end-portion and a movable radial end-portion, the stationary radial end-portion rigidly supported on the upper side of the base, an open position and a closed position, an inner arc and an outer arc, the two arcs having a common center, and being fully developed when the foldable body is in the open position;

a rigid leading rib connected along the movable radial end-portion, the rigid leading rib having an inner end and an outer end, the inner end being movable in the vicinity of the inner arc and the outer end being movable in the vicinity of the outer arc;

central transmission means having an inlet and an outlet, for transmitting substantially radial motion to the leading rib with the outlet being connected to the inner end of the leading rib, thus causing the folding body to fold and unfold in a radial manner, the transmission means supported on the base in the vicinity of the common center of the inner and outer arcs, and motion means connected to the inlet of the central transmission means for providing external motion to said central transmission means.

Preferably, the blind described above, comprises a second similar asssembly, with the option that some of the elements may be common to both assemblies.

Even more preferably, the two assemblies have a common transmission means, and a common base, the stationary end-portions of the foldable bodies of the first and second assemblies are disposed on the common base opposite to each other in a way to form an angle of substantially 180 degrees, the inner ends of the respective leading ribs of the two foldable bodies are connected to the common central transmission means in a manner to move against each other simultaneously, the two leading ribs are simultaneously disposed at substantially 180 degrees with respect to each other when the respective foldable bodies are in the closed position, and the leading ribs assume simultaneously an angle of substantially 0 degrees with respect to each other and substantially 90 degrees with respect to the base, when the respective foldable bodies are in the open position.

4. DESCRIPTION OF THE DRAWING.

The reader's understanding of practical implementation of preferred embodiments of the invention will be enhanced by reference to the following detailed description taken in conjunction with perusal of the drawing figures, wherein.

5. DETAILED DESCRIPTION OF THE INVENTION

The instant invention is directed to blinds for windows, and more specifically to foldable arcuate blinds for arched windows.

Figure 1:
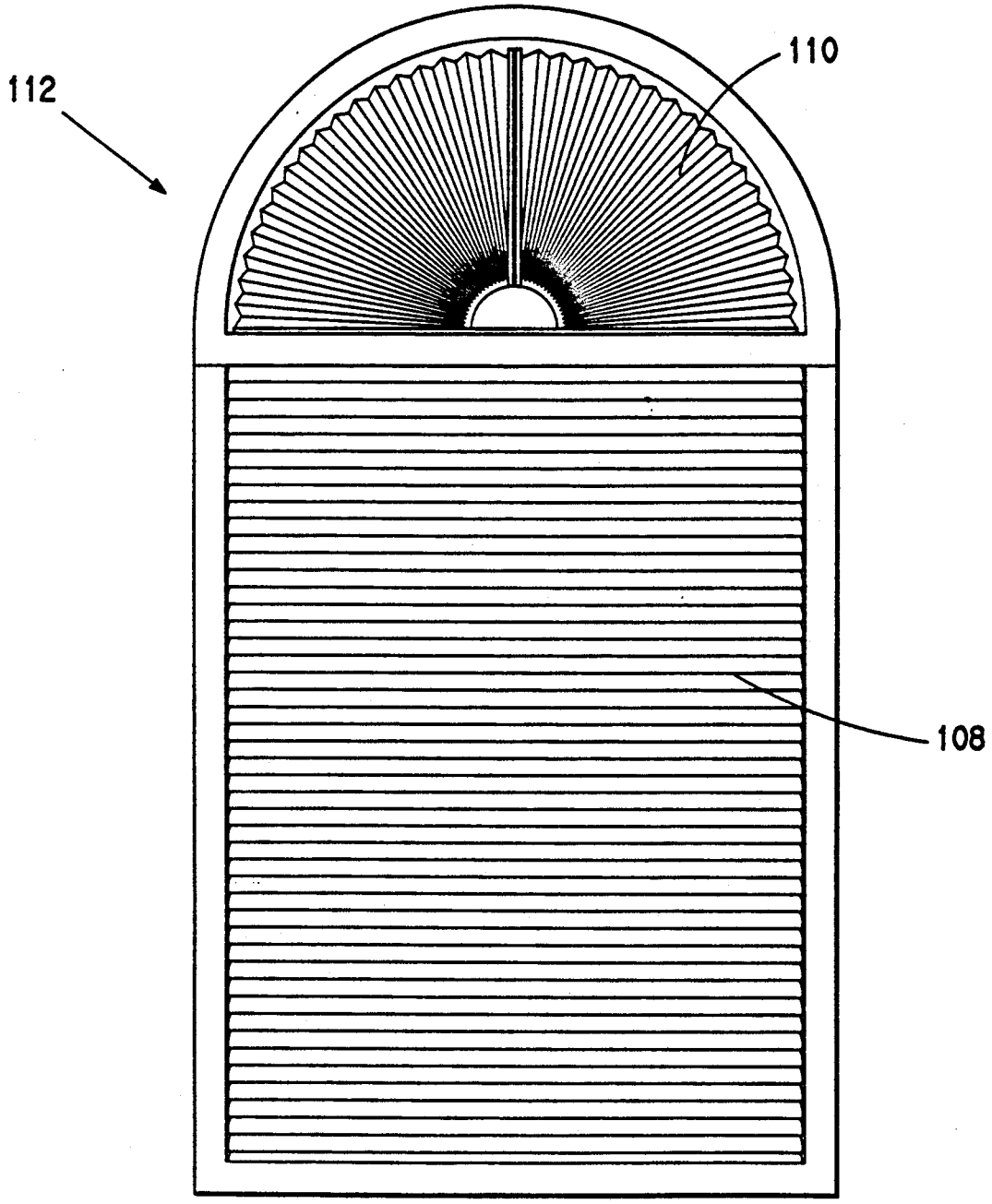
FIG. 1 is a schematic diagram showing an arched window with a blind according to this invention, as well as a conventional rectangular blind.

FIG. 1 gives a general view of an arched window 112 with an arcuate blind 110 according to this invention, as well as a conventional rectangular blind 108.

Figure 2:
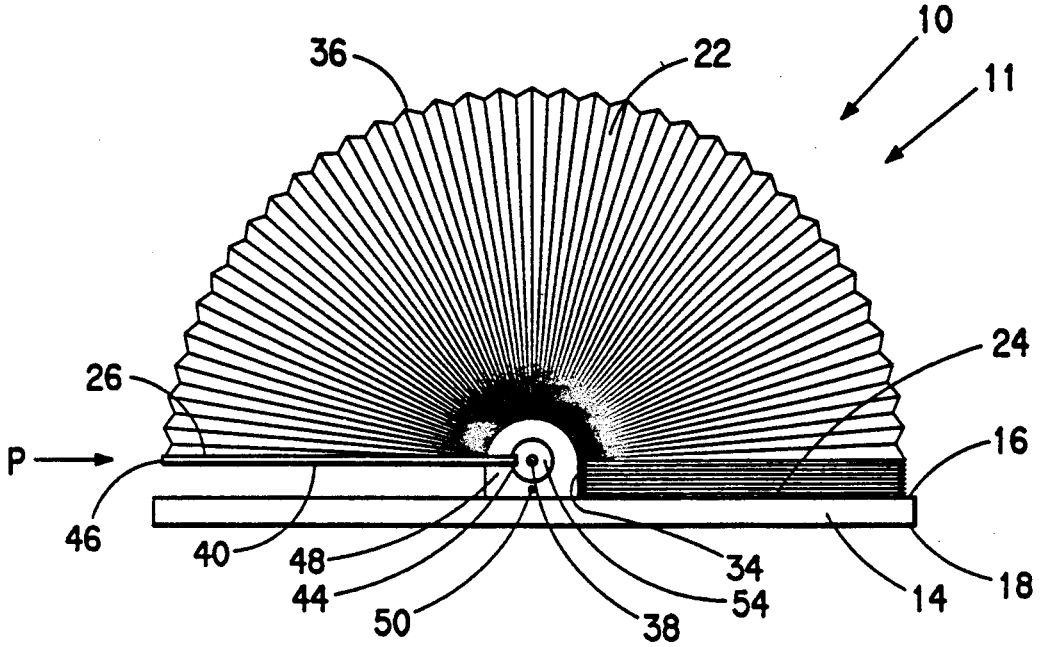
FIG. 2 is a schematic diagram illustrating the front view of an embodiment of this invention, wherein the arcuate blind is in the open position.
Figure 3:
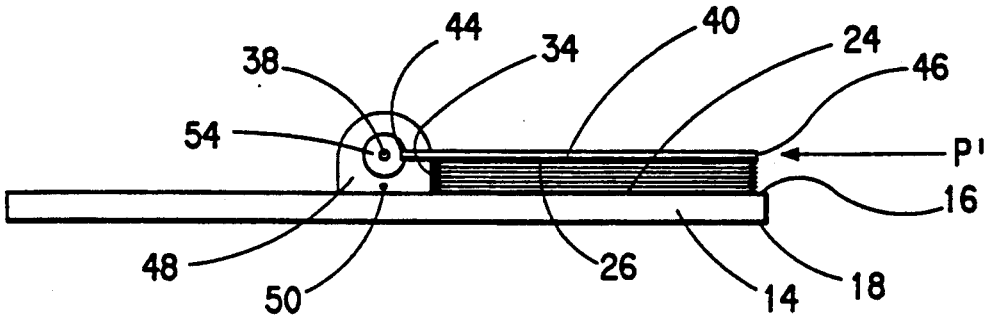
FIG. 3 is a schematic diagram illustrating the front view of the embodiment of FIG. 2, wherein the arcuate blind is in the closed position.
Figure 4:
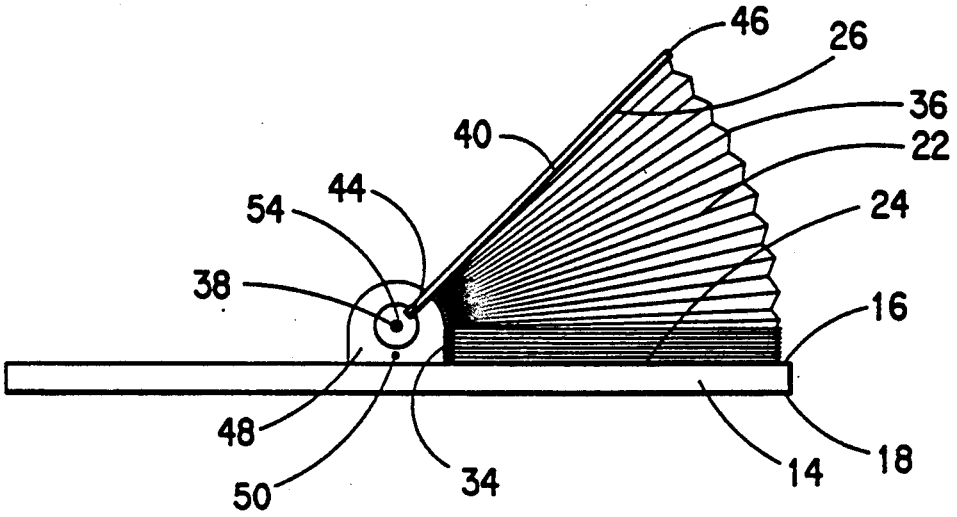
FIG. 4 is a schematic diagram showing the front view of the embodiment of FIG. 2, wherein the arcuate blind is in an intermediate position.

Referring now to FIGS. 2 through 4, an arcuate blind 10 is shown having a first assembly 11 of elements, which include a base 14. The base may be made of any structural material, such as wood, plastic in a plain or reinforced form, metal, and the like. Aluminum and steel are preferred metals of construction in the metal family for the purposes of this invention, while preferred plastics include but are not limited to polyacrylates, polymethacrylates, polyesters, polycarbonates, polyvinyl chloride plastisols, nylons, rigid polyurethanes, polypropylene, polyethylene, melamines, and the like. Regardless of the material used, an angled shape is preferable since it provides reinforcement, as well as a support for securing miscellaneous elements of the blind structure. The base 14 has an upper side 16 and a lower side 18.

There is also provided an arcuately foldable body 22, which may be of pleated fabric, or other types of pleated materials in thin sheet form, such as plastics, metals, and the like. Foldable body 22 may also be in the form of an old fashioned hand held fan composed of a plurality of thin strips, disposed parallel to each other, the strips always maintained in an overlapping mode. It is only important that the body 22 is foldable and that it is capable of providing a desired level of shade when in use.

The arcuately foldable body 22 has a stationary radial endportion 24, which is rigidly supported on the upper side 16 of base 14. The foldable body 22 also has a movable radial endportion 26, along which is connected a rigid leading rib 40. Body 22 may assume an open position when it is fully unfolded, as illustrated in FIG. 2, as well as a closed position, when it is completely folded, as illustrated in FIG. 3. An intermediate position of folding is illustrated in FIG. 4. The foldable body 22 possesses an inner arc 34 and an outer arc 36. The inner arc 34 provides clearance from the moving mechanisms which cause the blind to open and close, while arc 36 constitutes the outside border of the blind. The two arcs 34 and 36 have a common center 38, and they are fully developed when the foldable body 22 is in the open position, as illustrated in FIG. 2. It should be noted that small parts of the elements referred to in this description as arcs 34 an 36, especially the ones adjacent to the stationary endportion 24, and to a lesser extent the ones adjacent to the movable end-portion 26, escape the arcuate configuration and lean more toward linear configuration.

The rigid leading rib 40, which is connected along the movable radial end-portion 26, has to be rigid enough to lead and force the foldable body into the open, closed, and any intermediate positions. It may be of wood, metal, plastic, or other construction material suitable for this application, having a flat or reinforcing cross section, such as angular, corrugated, wavy, generally curved, and the like. Rib 40 has an inner end 44, which moves in the vicinity of the inner arc 34, and an outer end 46, which moves in the vicinity of the outer arc 36.

Within the fully developed inner arc 34 shown in FIG. 2, in the vicinity of center 38, there is supported on the base 14 a central transmission means, such as a mechanism 48, a detailed description of which is given hereinunder. Mechanism 48 has an inlet, such as shaft 50 at which it receives motion, and an outlet, such as gear 54, through which it may transmit substantially radial motion. Since gear 54 is connected to the inner end 44 of the leading rib 40, said substantially radial motion is transmitted to said rigid leading rib 40, which in turn controls the folding and unfolding of the arcuately foldable body 22. There is also furnished motion means (not shown in FIGS. 1-3) 56 connected to the inlet 50 of the central transmission means 48 for providing external motion to said central transmission means 48.

The most preferred embodiment of this invention, illustrated schematically in FIG. 6, comprises a second assembly 111A of elements as described for the first assembly 111 (referred to as assembly 11 in FIGS. 1 through 3) hereinabove, the two assemblies being interrelated as having common elements, such as the central transmission means 148. In addition the bases 114 and 114A may be considered to constitute just one base 114, since they are mere extensions of each other.

According to this most preferred embodiment of the instant invention, the stationary end-portions 124 and 124A of the foldable bodies 122 an 122A of the first 111 and the second 111A assemblies, respectively, are disposed on the common base 114 opposite to each other in a way to form an angle of substantially 180 degrees. In other words, the two stationary end-portions are substantially lying on a straight line. In addition, the inner ends 144 and 144A of the respective leading ribs 140 and 140A of the two foldable bodies 122 and 122A, are connected to the common central transmission means 154, in a manner to move against each other simultaneously, as it will be explained hereinbelow.

The two leading ribs 140 and 140A are simultaneously disposed at substantially 180 degrees with respect to each other when the respective foldable bodies 122 and 122A are in the closed position P1 and P1A, respectively. To avoid confusion, attention should be paid here to the fact that "closed position" is referred to the foldable bodies 122 and 122A, and not to the status of the blind itself. Thus, when the foldable bodies 122 and 122A are in the "closed position", the blind is actually "open", and vice versa. Ribs 140 and 140A also assume simultaneously an angle of degrees with respect to each other, and substantially 90 degrees with respect to the common base 114, when respective foldable bodies 122 and 122A are in the open position P2 and P2A. As aforementioned, at the "open position" of the foldable bodies, the blind itself is closed.

Figure 7:
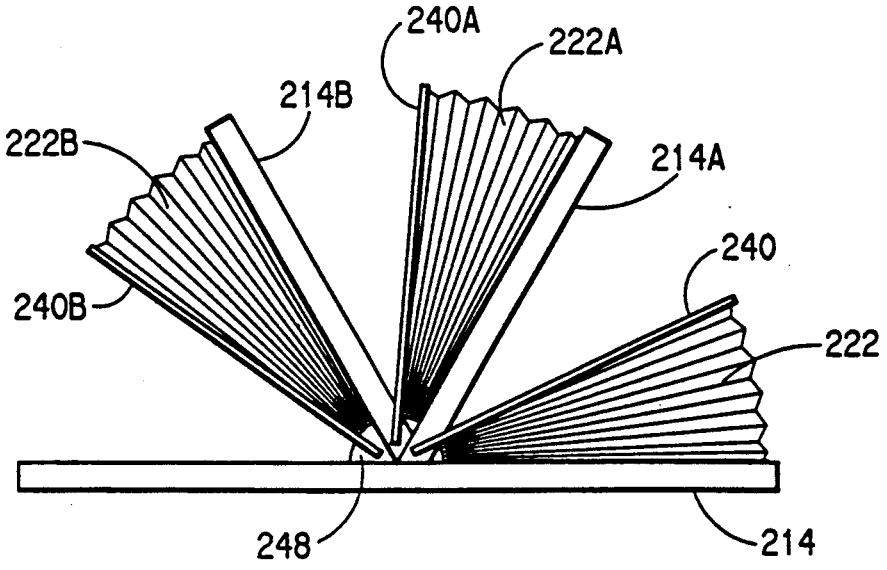
FIG. 7 is a schematic diagram illustrating a different configuration that the arcuate blind may assume according to a different embodiment of the instant invention.

The arcuate blind may also comprise any reasonable number of additional assemblies of elements of the type described above, as better illustrated in FIG. 7, which shows an example of three such assemblies, having a common central transmission means 248. In the embodiment of FIG. 7, there are provided three bases 214, 214A and 214B, corresponding to foldable bodies 222, 222A and 222B, as well to as to leading ribs 240, 240A and 240B, respectively. All ribs are connected to the common central transmission means 248. As it will be explained hereinunder, the direction of radial motion of each rib may be arranged to be in a clockwise or counterclockwise manner.

Figure 5:
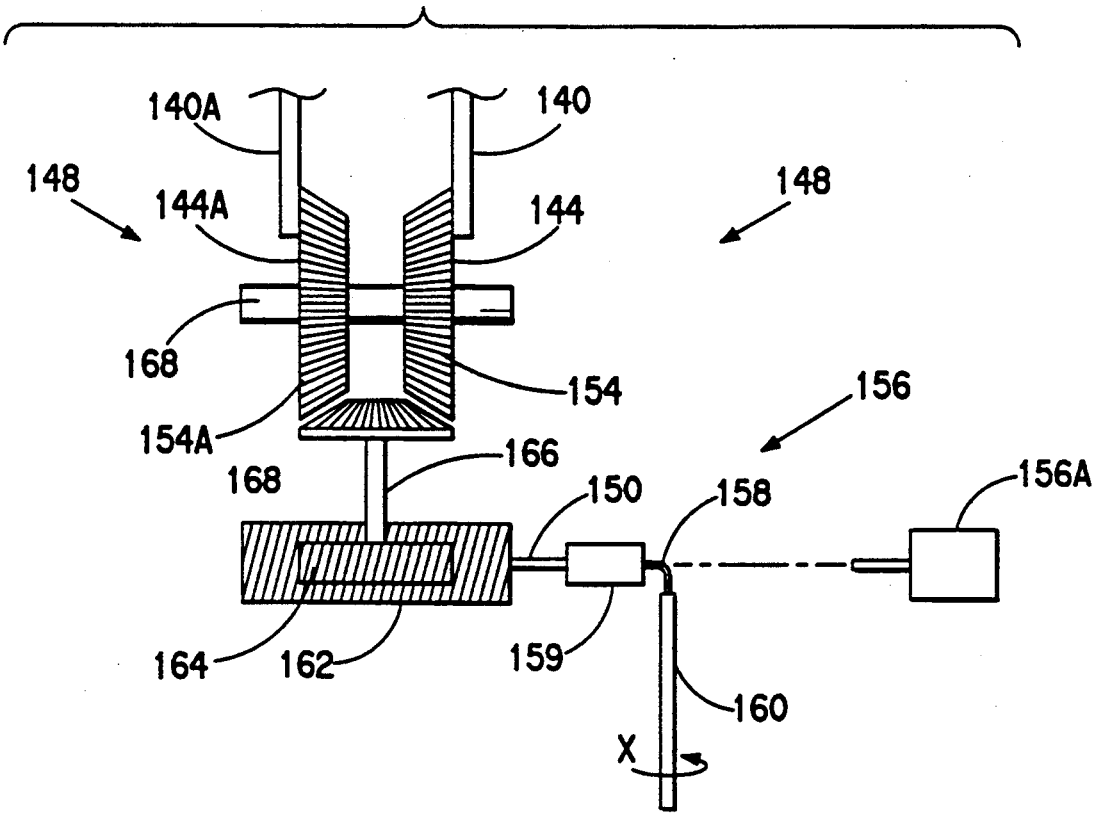
FIG. 5 is a schematic diagram showing the preferred mechanism of transmitting radial motion to the leading ribs for opening and closing the arcuate blind according to the present invention.

A more detailed illustration of an example of a central transmission means 148 according to the most preferred embodiment of this invention is outlined in FIG. 5. FIG. 5, also includes an illustration of motion means 156 connected to the inlet 150 of transmission means 148.

The inlet, which may be in the form of a first shaft 150, is connected at one end to the motion means 156, and to a worm gear 162 at the other end. Worm gear 162 is engaged with complementary gear 164, which in turn provides rotational motion to bevel gear 168 through a second shaft 166. Bevel gear 168, being in engagement with output gears 154 and 154A transfers rotational motion to said output gears. The output gears 154 and 154A are related in an idle manner with respect to each other. This means that the two gears may turn in any direction and speed independently of each other, which may be achieved by having at least on of the output gears idly connected over a third shaft 168.

Two important facts should be kept in mind regarding this type of transmission:

(a) When output gear 154 turns clockwise, output gear 154A turns counterclockwise, and vice versa; and (b) Worm gear 162, being on the side of motion means 156, may transfer external motion to the output gears 154 and 154A, provided by said motion means 156 through shaft 150, while in contrast, outlet gears 154 and 154A may not transfer motion to worm gear 162 if some force tending to turn outlet gears 154 and 154A is applied on said gears. Thus, worm gear 162, despite the fact that it may transfer motion, it also acts as a brake at all times against any movement of gears 154 and 154A, which movement is not provided through the worm gear 162 itself.

Figure 6:
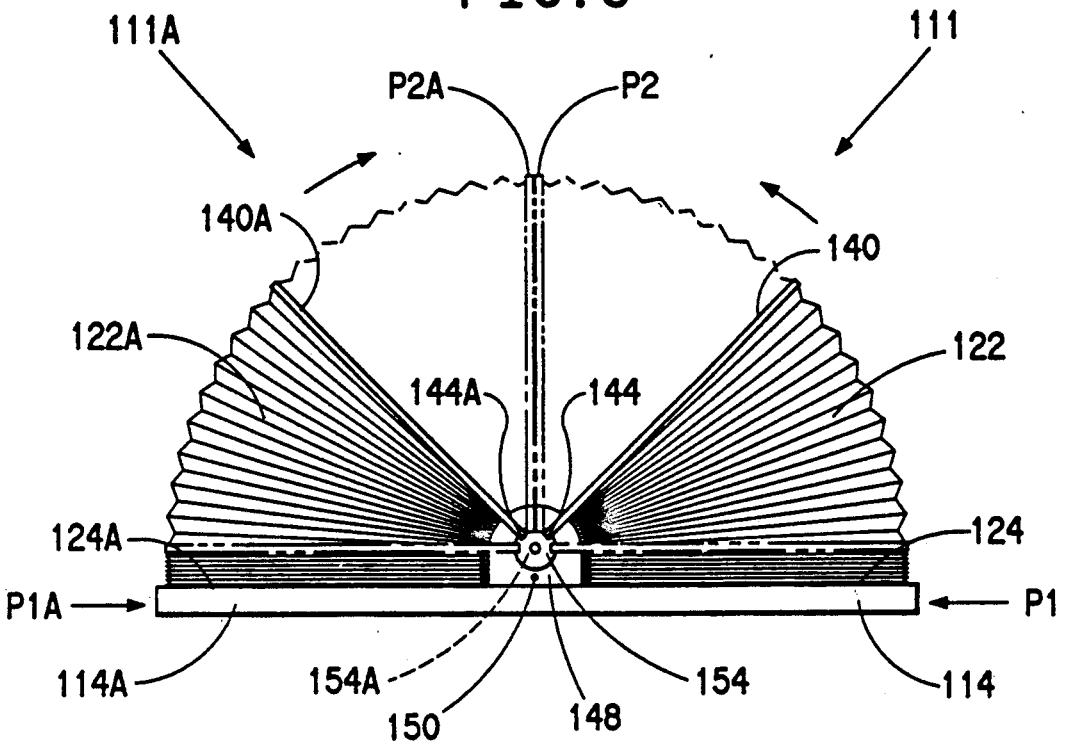
FIG. 6 is a schematic diagram showing the preferred configuration of the arcuate blind according to the instant invention.

Thus, by rigidly connecting the inner end 144 of the leading rib 140 on the outlet gear 154, and the inner end 144A of the leading rib 140A on the outlet gear 154A, as shown in FIG. 5, one may achieve the radial motions required in the preferred embodiment illustrated in FIG. 6. It should be understood that in the case of the embodiment illustrated in FIGS. 2, 3, and 4, wherein only one foldable body is in effect, only one outlet gear, such as 154 is needed for a certain direction of folding or unfolding the foldable body; gear 154A may be omitted altogether. If the opposite direction of folding and unfolding is desired, then gear 154 is omitted and gear 154A is used. In the case of a plurality of foldable bodies, such as in the embodiment illustrated in FIG. 7, the respective leading ribs may be connected to one or the other or some to one and some to the other outlet gear to reflect the corresponding desirable motions. It is usually desirable to have either all foldable bodies to fold or unfold in the same direction, or arrange them in pairs, the members of each pair folding or unfolding in opposite direction. Any desired combination, however, may be used and falls well within the limits of the present invention.

A decorative small panel may be installed in front part of the blind, in the vicinity of the center !38 to hide the transmission means 148, if desired The motion mean 156 is an assembly of a coupler 159 connected at one end to flexible joint 158, and to the first shaft 150 at the other end. Similarly, the remaining free end of flexible joint 158 is connected to elongated handling rod 160, turning of which will cause the folding bodies 122 and 122A to assume their open, closed, and intermediate positions, as shown in FIG. 6. Handling rod 160 may be hanging under flexible joint 158 in front of the window, in the vicinity of the middle portion of the window. However, by using an adequately elongated coupler and turning the outlet gears along with the blind by 90 degrees with respect to the worm gear, the rod may be positioned at one side of the window. Other conventional mechanisms may also be used disposing the handling rod at the side of the window. It is desirable for such mechanisms to be placed near the base in order to be more easily hidden.

In operation of the most preferred embodiment, as illustrated in FIGS. 5 and 6, the foldable bodies 122 and 122A are originally in their initial closed positions P1, and P1A, when the blind is open. When it becomes desirable to close the blind, the operator turns rod 160 in a twisting rotational motion as shown by the arrow X. This motion passes through flexible joint 158, coupler 159, shaft 150, and turns the worm gear 162. The worm gear in sequence, turns the complementary gear 164, which turns shaft 166, which turns bevel gear 168, which finally turns the outlet gears 154 and 154A. The outlet gears 154 and 154A, being connected to the inner ends 144 and 144A of the leading ribs 140, and 140A, cause said leading ribs to advance in opposite directions, and gradually unfold the foldable bodies 122 and 122A, until ribs 140 and 140A assume their final positions P2 and P2A, after passing, of course, through all intermediate positions. If the operator desires to have the blinds only partially open or closed, he or she may stop turning the rod 160 at any intermediate position. Since the worm gear 162 is on the side of the inlet 150, it will act as a brake and will not allow any spontaneous movement of the blind, which otherwise would have been caused by turning of the outlet gears, due to the weight of and leverage applied by the components of the blind, when the ribs are at any positions other than the initial positions P1 and P1A. This is a great advantage that the worm gear provides. When the operator wishes to open the blind again, he or she simply turns the rod in the opposite direction, causing all involved elements to follow a path opposite to the one described for closing the blind.

The flexible joint 158, and the manually operated rod 160 may be replaced by a motor, preferably an electric motor 156A. The electric motor may be of A.C. or D.C. type, preferably supplied by a low voltage source, preferably of the order of 6 to 24 volts. Since the energy required to turn the worm gear is rather low for windows of reasonable size, the source will also be rather inexpensive. D.C. motors are preferable since mere change of polarity in their input reverses the rotation direction. Conventional switching mechanisms may be employed in conjunction with the motor to automatically stop the rotational motion when terminal positions, or even other positions if so desired, are reached. The switcing mechanism may also be in the form of a contact lead secured on each of two respective elements, such as the two leading ribs 140A and 140, for example, in the embodiment of FIG. 6. When the two leads come in contact, a relay may be energized in order to shut off the motor which gives the rotational motion.

The contact leads may be secured in such positions of the ribs, to allow some overlap of terminal positions P2 and P2A. In any event, as already mentioned hereinabove, different types of conventional and well known in the art switching mechanisms may be utilized in the practice of the instant invention.

Figure 8:
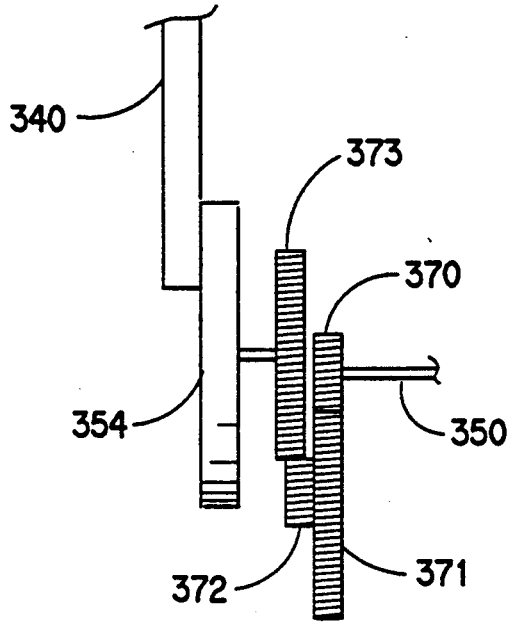
FIG. 8 is a schematic diagram showing an alternate mechanism of transmitting radial motion to the leading ribs for opening and closing the arcuate blind according to the present invention.

An alternate central transmission mechanism is shown in FIG. 8 as having an inlet shaft 350, and transmitting motion to outlet wheel 354 through the cooperation of a train of gears 370, 371, 372, and 373. This mechanism, although falling within the borders of this invention, is not as effective as the one of the most preferred embodiment, since it does not provide breaking action against spontaneous movements of the outlet wheel 354.

Figure 9A:
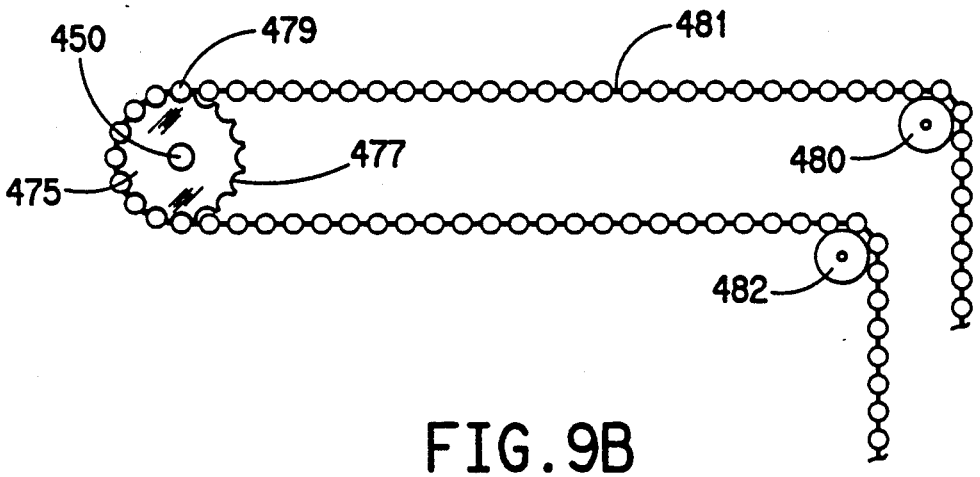
FIG. 9 is a schematic diagram illustrating an example of motion means for providing external motion to the transmission means according to an alternate embodiment of the present invention.
Figure 9B:
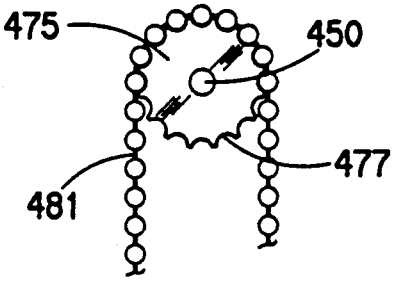

An alternate motion means is shown in FIG. 8. Cam 475 having recessed portions 477, is centrally connected to the inlet shaft 450 of the transmission means (not shown). Bead chain 481, having beads commensurate in size with the recessed portions 477 may turn the cam 475 in one or the opposite direction, depending on which side of the bead chain is pulled. The cam 475 gives in turn motion to the inlet shaft 450. Pulleys 480 and 482 may be used for disposing the chain at one side of the window (FIG. 9*a*), while the straight structure shown in FIG. 9*b* is used for the chain to be disposed in the vicinity of the middle portion of the window.

Examples demonstrating the operation of the instant invention have been given for illustration purposes only, and should not be construed as restricting the scope or limits of this invention in any way.

What is claimed is:

1. An arcuate blind for arched windows having a first assembly of elements comprising:

a base having an upper side and a lower side;

an arcuately foldable body being adaptable to assume an open position and a closed position, the arcuately foldable body having a stationary radial end-portion and a movable radial end-portion, the stationary radial end-portion rigidly supported on the upper side of the base, an inner arc and an outer arc, the two arcs having a common center, and being fully developed when the foldable body is in the open position;

a rigid leading rib connected along the movable radial endportion, the rigid leading rib having an inner end and an outer end, the inner end being movable in the vicinity of the inner arc and the outer end being movable in the vicinity of the outer arc;

central transmission means having an inlet and an outlet, for transmitting substantially radial motion to the leading rib with the outlet being connected to the inner end of the leading rib, thus causing the foldable body to fold and unfold in a radial manner, the transmission means supported on the base in the vicinity of the common center of the inner and outer arcs, the central transmission means comprising a worm gear, the worm gear being positioned in a manner to act as a brake against any spontaneous movement of the blind; and motion means connected to the inlet of the central transmission means for providing external motion to said central transmission means.

2. An arcuate blind as defined in claim 1, further comprising a second assembly similar to the first assembly, wherein the two assemblies have a common transmission means, and a common base, the stationary end-portions of the foldable bodies of the first and second assemblies are disposed on the common base opposite to each other in a way to form an angle of substantially 180 degrees, the inner ends of the respective leading ribs of the two foldable bodies are connected to the common central transmission means in a manner to move against each other simultaneously, the two leading ribs are simultaneously disposed at substantially 180 degrees with respect to each other when the respective foldable bodies are in the closed position, and the leading ribs assume simultaneously an angle of substantially 0 degrees with respect to each other and substantially 90 degrees with respect to the base, when the respective foldable bodies are in the open position.

3. An arcuate blind as defined in claim 1, wherein the motion means comprises an electric drive.

4. An arcuate blind as defined in claim 2, wherein the motion means comprises an electric drive.

5. An article comprising a window having an arched portion, and an arcuate blind disposed within the arched portion of the window, the arcuate blind having a first assembly of elements comprising:

a base having an upper side and a lower side;

an arcuately foldable body being adaptable to assume an open position and a closed position, the arcuately foldable body having a stationary radial end-portion and a movable radial end-portion, the stationary radial end-portion rigidly supported on the upper side of the base, an inner arc and an outer arc, the two arcs having a common center, and being fully developed when the a rigid leading rib connected along the movable radial endportion, the rigid leading rib having an inner end and an outer end, the inner end being movable in the vicinity of the inner arc and the outer end being movable in the vicinity of the outer arc;

central transmission means having an inlet and an outlet, for transmitting substantially radial motion to the leading rib with the outlet being connected to the inner end of the leading rib, thus causing the foldable body to fold and unfold in a radial manner, the transmission means supported on the base in the vicinity of the common center of the inner and outer arcs, the central transmission means comprising a worm gear, the worm gear being positioned in a manner to act as a brake against any spontaneous movement of the blind; and motion means connected to the inlet of the central transmission means for providing external motion to said central transmission means.

6. An article as defined in claim 5, wherein the arcuate blind further comprises a second assembly similar to the first assembly, wherein the two assemblies have a common transmission means, and a common base, the stationary end-portions of the foldable bodies of the first and second assemblies are disposed on the common base opposite to each other in a way to form an angle of substantially 180 degrees, the inner ends of the respective leading ribs of the two foldable bodies are connected to the common central transmission means in a manner to move against each other simultaneously, the two leading ribs are simultaneously disposed at substantially 180 degrees with respect to each other when the respective foldable bodies are in the closed position, and the leading ribs assume simultaneously an angle of substantially 0 degrees with respect to each other and substantially 90 degrees with respect to the base, when the respective foldable bodies are in the open position.

* * * * *